US007279261B2

(12) United States Patent
Lee et al.

(10) Patent No.: US 7,279,261 B2
(45) Date of Patent: Oct. 9, 2007

(54) EMULSION AGGREGATION TONER COMPOSITIONS

(75) Inventors: Eunhee Lee, Honeoye Falls, NY (US); Grazyna Kmieck-Lawrynowicz, Fairport, NY (US); Karen Lamora, Marion, NY (US)

(73) Assignee: Xerox Corporation, Stamford, CT (US)

( * ) Notice: Subject to any disclaimer, the term of this patent is extended or adjusted under 35 U.S.C. 154(b) by 367 days.

(21) Appl. No.: 11/034,067

(22) Filed: Jan. 13, 2005

(65) Prior Publication Data

US 2006/0154167 A1 Jul. 13, 2006

(51) Int. Cl.
*G03G 9/087* (2006.01)

(52) U.S. Cl. ..... 430/109.3; 430/110.4; 430/137.14

(58) Field of Classification Search ..... 430/109.3, 430/109.4, 110.4, 137.14
See application file for complete search history.

(56) References Cited

U.S. PATENT DOCUMENTS

| | | | |
|---|---|---|---|
| 3,590,000 | A | 6/1971 | Palermiti et al. |
| 3,800,588 | A | 4/1974 | Larson et al. |
| 3,847,604 | A | 11/1974 | Hagenbach et al. |
| 3,944,493 | A | 3/1976 | Jadwin et al. |
| 4,007,293 | A | 2/1977 | Mincer et al. |
| 4,079,014 | A | 3/1978 | Burness et al. |
| 4,338,390 | A | 7/1982 | Lu |
| 4,394,430 | A | 7/1983 | Jadwin et al. |
| 4,560,635 | A | 12/1985 | Hoffend et al. |
| 4,935,326 | A | 6/1990 | Creatura et al. |
| 4,937,166 | A | 6/1990 | Creatura et al. |
| 5,114,819 | A | 5/1992 | Ong et al. |
| 5,223,370 | A | 6/1993 | Sacripante et al. |
| 5,278,020 | A | 1/1994 | Grushkin et al. |
| 5,290,654 | A | 3/1994 | Sacripante et al. |
| 5,308,734 | A | 5/1994 | Sacripante et al. |
| 5,334,471 | A | 8/1994 | Sacripante et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,403,693 | A | 4/1995 | Patel et al. |
| 5,405,728 | A | 4/1995 | Hopper et al. |
| 5,418,108 | A | 5/1995 | Kmiecik-Lawrynowicz et al. |
| 5,462,828 | A | 10/1995 | Moffat et al. |
| 5,496,676 | A | 3/1996 | Croucher et al. |
| 5,501,935 | A | 3/1996 | Patel et al. |
| 5,527,658 | A | 6/1996 | Hopper et al. |
| 5,585,215 | A | 12/1996 | Ong et al. |
| 5,593,807 | A | 1/1997 | Sacripante et al. |
| 5,650,255 | A | 7/1997 | Ng et al. |
| 5,650,256 | A | 7/1997 | Veregin et al. |
| 5,723,253 | A | 3/1998 | Higashino et al. |
| 5,744,520 | A | 4/1998 | Kmiecik-Lawrynowicz et al. |
| 5,747,215 | A | 5/1998 | Ong et al. |

(Continued)

FOREIGN PATENT DOCUMENTS

| | | |
|---|---|---|
| WO | WO 94/01446 | 5/1994 |

*Primary Examiner*—John L Goodrow
(74) *Attorney, Agent, or Firm*—Oliff & Berridge, PLC

(57) ABSTRACT

A toner includes particles of a resin, a leveling agent, an optional colorant, and additional optional additives, where the leveling agent is selected from silicon containing leveling agents, and mixtures thereof, and where the toner particles are prepared by an emulsion aggregation process.

20 Claims, 2 Drawing Sheets

U.S. PATENT DOCUMENTS 5,763,133 A 6/1998 Ong et al.
5,766,818 A 6/1998 Smith et al.
5,804,349 A 9/1998 Ong et al.
5,827,633 A 10/1998 Ong et al.
5,840,462 A 11/1998 Foucher et al.
5,853,943 A 12/1998 Cheng et al.
5,853,944 A 12/1998 Foucher et al.
5,869,215 A 2/1999 Ong et al.
5,902,673 A 5/1999 Missell et al.
5,916,725 A 6/1999 Patel et al.
5,945,245 A 8/1999 Mychajlowskij et al.
5,948,585 A 9/1999 Gady et al.
6,030,739 A 2/2000 Ishikawa et al.
6,120,967 A 9/2000 Hopper et al.
6,130,021 A * 10/2000 Patel et al. ..... 430/137.14
6,458,501 B1 10/2002 Cheng et al.
6,503,676 B2 1/2003 Yamashita et al.
6,544,709 B1 4/2003 Wang et al.
6,687,483 B2 2/2004 Chen et al.
2003/0180643 A1 9/2003 Suzuki et al.
2004/0058268 A1 * 3/2004 Veregin et al. ..... 430/137.14

* cited by examiner

EMULSION AGGREGATION TONER COMPOSITIONS

BACKGROUND

Emulsion aggregation toners are excellent toners to use in forming print and/or xerographic images in that the toners can be made to have uniform sizes and in that the toners are environmentally friendly. U.S. patents describing emulsion aggregation toners include, for example, U.S. Pat. Nos. 5,370,963, 5,418,108, 5,290,654, 5,278,020, 5,308,734, 5,344,738, 5,403,693, 5,364,729, 5,346,797, 5,348,832, 5,405,728, 5,366,841, 5,496,676, 5,527,658, 5,585,215, 5,650,255, 5,650,256, 5,501,935, 5,723,253, 5,744,520, 5,763,133, 5,766,818, 5,747,215, 5,827,633, 5,853,944, 5,804,349, 5,840,462, and 5,869,215.

Two main types of emulsion aggregation toners are known. First is an emulsion aggregation process that forms acrylate based, e.g., styrene acrylate, toner particles. See, for example, U.S. Pat. No. 6,120,967, incorporated herein by reference in its entirety, as one example of such a process. Second is an emulsion aggregation process that forms polyester, e.g., sodio sulfonated polyester toner particles. See, for example, U.S. Pat. No. 5,916,725, incorporated herein by reference in its entirety, as one example of such a process.

Emulsion aggregation techniques typically involve the formation of an emulsion latex of the resin particles, which particles have a small size of from, for example, about 5 to about 500 nanometers in diameter, by heating the resin, optionally with solvent if needed, in water, or by making a latex in water using an emulsion polymerization. A colorant dispersion, for example of a pigment dispersed in water, optionally also with additional resin, is separately formed. The colorant dispersion is added to the emulsion latex mixture, and an aggregating agent or complexing agent is then added to form aggregated toner particles. The aggregated toner particles are heated to enable coalescence/fusing, thereby achieving aggregated, fused toner particles.

U.S. Pat. No. 5,462,828 describes a toner composition that includes a styrene/n-butyl acrylate copolymer resin having a number average molecular weight of less than about 5,000, a weight average molecular weight of from about 10,000 to about 40,000 and a molecular weight distribution of greater than 6 that provides excellent gloss and high fix properties at a low fusing temperature.

What is still desired is a styrene acrylate type emulsion aggregation toner that can achieve excellent print quality, particularly gloss, for all colors.

SUMMARY

Embodiments comprise toners and developers containing the toners for use in forming and developing images of good quality and gloss, and in particular to toners including leveling agents to provide the desired print quality and high gloss.

In embodiments, the toner and developer compositions include toner particles containing at least one leveling agent that enables achievement of excellent gloss properties.

Particular embodiments provide a toner comprising particles of resin, leveling agent, and optional colorant, wherein the leveling agent is selected from the group consisting of polysiloxanes and mixtures thereof, and wherein said toner particles are prepared by an emulsion aggregation process.

In embodiments, toner compositions comprise toner particles formed by an emulsion/aggregation process, wherein the emulsion/aggregation process comprises providing one or more aqueous dispersions, the aqueous dispersions comprising one or more leveling agent and particles including particles of one or more resins; homogenizing the aqueous dispersions; aggregating particles to form aggregated particles; coalescing the aggregated particles to form fused particles; and optionally removing the fused particles from the aqueous dispersion; in which the fused particles have an average particle diameter of from about 1 to about 15 microns, with a particle geometric size distribution of less than about 1.25.

In further embodiments, developer compositions comprise toner compositions including toner particles formed by an emulsion/aggregation process, wherein the emulsion/aggregation process comprises providing one or more aqueous dispersions, the aqueous dispersions comprising one or more leveling agent and particles including particles of one or more resins; homogenizing the aqueous dispersions; aggregating particles to form aggregated particles; coalescing the aggregated particles to form fused particles; and optionally removing the fused particles from the aqueous dispersion; in which the fused particles have an average particle diameter of from about 1 to about 15 microns, with a particle geometric size distribution of less than about 1.25.

In still further embodiments, a process for preparing toner particles is provided, in which the process comprises providing one or more aqueous dispersions, the aqueous dispersions comprising one or more leveling agent and particles including particles of one or more resins; homogenizing the aqueous dispersions; aggregating particles to form aggregated particles; coalescing the aggregated particles to form fused particles; and optionally removing the fused particles from the aqueous dispersion; in which the fused particles have an average particle diameter of from about 1 to about 15 microns, with a particle geometric size distribution of less than about 1.25.

BRIEF DESCRIPTION OF THE DRAWINGS

A more complete understanding can be obtained by reference to the accompanying drawings wherein.

DETAILED DESCRIPTION OF PREFERRED EMBODIMENTS

Figure 1:
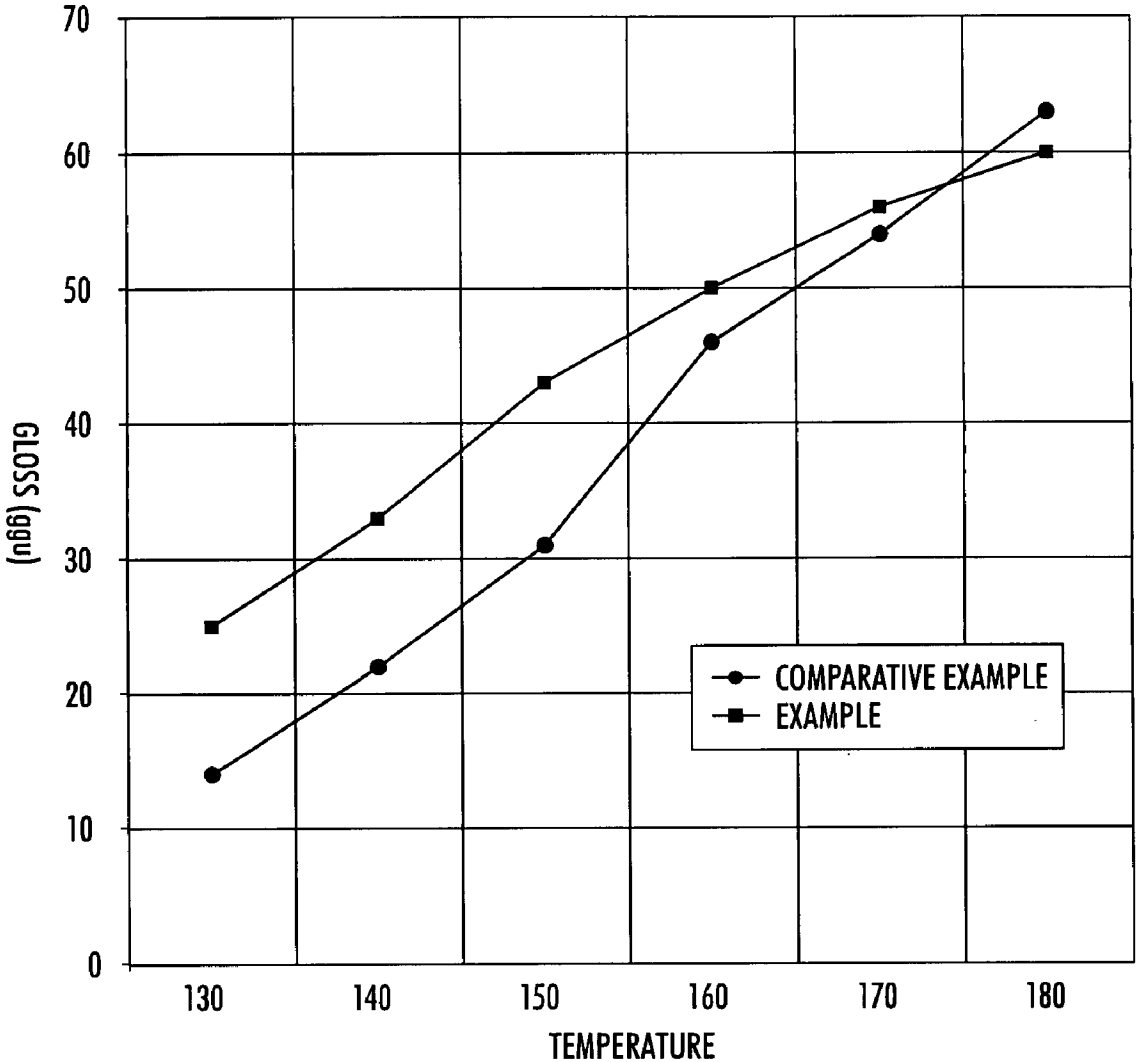
FIG. 1 is a graphical representation of the relationship between gloss and fusing temperature for a conventional chemical toner and a chemical toner according to an embodiment.

In embodiments, a toner composition comprises toner particles comprised of at least a latex emulsion polymer resin and an optional colorant dispersion. The toner particles also include at least a leveling agent.

Embodiments are generallydirected to toner compositions comprising toner particles comprised of at least a latex emulsion polymer resin, an optional colorant dispersion and at least a leveling agent. Further embodiments are directed to emulsion/aggregation processes for the preparation of toner compositions.

Specifically, embodiments relate to the emulsion/aggregation/coalescence processes for making toner particles including leveling agents. In such a process, for example, resin is prepared as a water-based dispersion of generally sub-micron sized polymeric particles (polymeric latex), which are then aggregated with leveling agents emulsions, optionally with dispersions of colorants and/or other additives, which also may be in the form of sub-micron particles, to the desired size and are then coalesced to produce toner particles.

Toner compositions according to embodiments comprise a solid film-forming resin, leveling agents, optionally with one or more colorants such as pigments and/or dyes, and optionally also containing one or more additives, such as gel latex, magnetites, flocculants, curing agents, waxes, charge additives, flow-promoting agents, flow-control agents, plasticizers, stabilizers, anti-gassing agents, antioxidants, UV absorbing agents, light stabilizers, fillers and the like.

In conventional emulsion/aggregation/coalescence processes for preparing toners, latex emulsions of at least one resin, optionally pigment dispersions and other optional components are combined to obtain a toner formulation at the start of the toner aggregation process. The latex emulsion is subjected to an emulsion/aggregation process, wherein the latex emulsion is allowed to aggregate to form aggregate particles. The latex emulsion may be mixed by any suitable method, including but not limited to agitation. The latex emulsion mixture may be heated, in embodiments, to a temperature at, above or below the glass transition temperature of the resin, to aggregate the particles. However, aggregation can also be achieved without heating the composition.

In embodiments, the resin is preferably selected from the group consisting of thermoset resins, curable resins, thermoplastic resins and mixtures thereof, although other suitable resins can also be used. Non-limiting examples of suitable resins include epoxy resins, poly-functional epoxy resins, polyol resins, polycarboxylic acid resins, poly (vinylidene fluoride) resins, polyester resins, carboxy-functional polyester resins, hydroxy-functional polyester resins, acrylic resins, functional acrylic resins, polyamide resins, polyolefin resins, plasticized polyvinyl chloride (PVC), polyester and poly (vinylidene fluoride), ionomers, styrene, copolymers comprising styrene and an acrylic ester and mixtures thereof.

Toner particles formed from any of the above resins or combinations of resins in various exemplary embodiments may or may not be cross-linked. Any suitable cross-linking agent may be used, as desired. Suitable cross-linking agents include, but are not limited to, amines, anhydrides, isocyanates, divinyl benzene, divinyl toluene, diacrylates, dimethacrylates, and the like.

The latex emulsion of resin may be formed by forming a latex of at least one resin, selected from those described above, in water. The resin may be prepared by bulk polymerization or by a polycondensation process, and in which the resin is rendered hydrophilic by incorporation of alkali sulfonated monomers, for instance, as disclosed in U.S. Pat. Nos. 5,593,807 and 5,945,245, each of which is incorporated herein by reference in its entirety, and in which the resin selected may contain functional groups that render them dissipatable; that is, they form spontaneous emulsions in water without the use of organic solvents, especially above the glass transition temperature, Tg, of the resin. In other embodiments, the resin selected may require the use of organic solvents miscible with water, followed by an emulsification process in water and then followed by stripping the solvent from water to form an aqueous resin dispersion. The latex of suspended resin particles may be comprised of particles that have an average size of, for example, from about 5 to about 500 nanometers and, in embodiments, from about 10 to about 250 nanometers in volume average diameter, as measured by any suitable device such as, for example, a NiCOMP® sizer. The particles may comprise, for example, about 5 to about 40 percent by weight of the latex emulsion.

Alternatively, the latex may be formed by emulsion polymerization. Techniques for emulsion polymerization are known in the art and are described in, for example, U.S. Pat. Nos. 6,458,501 and 5,853,943, each of which is incorporated herein by reference in its entirety. Synthesized acrylic and methacrylic acid-containing acrylic emulsions, glycidyl methacrylate functional acrylic emulsions, carboxylic acid-terminated dissipatible polyester emulsions and commercial epoxy resin emulsions provide materials that can also be used.

Resin is generally present in the toner in any sufficient, but effective, amount. In embodiments, resin may be present in an amount of from about 50 to about 100 percent by weight of a toner composition. In embodiments, resin may be present in an amount of from about 70 to about 90 percent by weight of the toner composition.

Illustrative examples of specific latex for resin, polymer or polymers selected for the toner of the present invention include, for example, poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(styrene-butadiene), poly (methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly (ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), and poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly (styrene-butyl acrylate-methacrylic acid), poly(styrene-butyl acrylate-acrylonitrile), poly(styrene-butyl acrylate-acrylonitrile-acrylic acid), and other similar polymers.

As the latex emulsion polymer of the toner of embodiments, a styrene-alkyl acrylate may be used. In further embodiments, the styrene-alkyl acrylate is a styrene/n-butyl acrylate copolymer resin or a styrene-butyl acrylate beta-carboxyethyl acrylate polymer.

The latex polymer may be present in an amount of from about 70 to about 95 percent by weight of the toner particles (i.e., toner particles exclusive of external additives) on a solids basis, or from about 75 to about 85 percent by weight of the toner.

The monomers used in making the selected polymer are not limited, and the monomers utilized may include any one or more of, for example, styrene, acrylates such as methacrylates, butylacrylates, β-carboxy ethyl acrylate (β-CEA), etc., butadiene, isoprene, acrylic acid, methacrylic acid, itaconic acid, acrylonitrile, benzenes such as divinylbenzene, etc., and the like. Known chain transfer agents, for example dodecanethiol or carbon tetrabromide, can be utilized to control the molecular weight properties of the polymer. Any suitable method for forming the latex polymer from the monomers may be used without restriction.

Furthermore, the toner compositions of embodiments also include at least one leveling agent such as silicones. In embodiments, the leveling agent allows regulation of the surface gradient after a film formed by the toner composition solidifies. That is, the surface gradient of a fused toner image may be regulated by the use of a leveling agent, as in embodiments. In addition, the siloxane leveling agents of particular embodiments also acts to lower the coefficient of friction at the surface, due to siloxane functional groups within the leveling agents, thus allowing achievement of improved release properties from the fuser, as indicated by measurement of the stripping force.

In embodiments, the leveling agent may be mixed with the latex emulsion of resin prior to aggregation. The leveling agent may be added directly, or in the form of an aqueous solution, emulsion or dispersion.

Suitable leveling agents that may be used in embodiments include, but are not limited to, silicones; polysiloxanes such as dialkyl polysiloxane with terminal functionality selected from the group consisting of amino, hydroxyl, carboxyl, carbinol, (meth)acrylate, halo alkoxy, hydride, haloalkyl, mercapto, acid anhydride, carboxyalkyl, and vinyl groups; crosslinked polydimethylsiloxane; functionalized polysiloxanes, such as polyether-modified polysiloxanes; fluorocarbon-based surfactants; and mixtures thereof. The commercially available silicones selected possess, for example, a weight average molecular weight of from about 1,000 to about 200,000, while the commercially available crosslinked siloxanes utilized are believed to have a weight average molecular weight of from about 40,000 to about 1,000,000.

In embodiments, additional additives may be incorporated, optionally in the form of dispersions, to the latex emulsion of resin prior to aggregation. Additives may be added, in embodiments, for any of various reasons, including, but not limited to, providing color, improving charging characteristics and improving flow properties. For example, additives including, but not limited to, colorants; magnetites; waxes; curing agents; charge additives; flow-promoting agents, such as silicas; flow-control agents; surfactants; plasticizers; stabilizers, such as stabilizers against UV degradation; anti-gassing and degassing agents, such as benzoin, surface additives; antioxidants; UV absorbers; light stabilizers; flocculates and aggregating agents; and fillers may be included.

In various embodiments of the invention, a colorant may be included in known amounts, to achieve a desired color strength. For example, in embodiments, at least one dye, pigment, mixtures thereof, and/or other colorant is included in a toner composition in a suitable amount. In embodiments, the at least one dye, pigment, mixtures thereof, and/or other colorant is included in an amount from about 1 to about 20 percent by weight of the toner composition. In various exemplary embodiments, the colorant is included in an amount of from about 2 to about 10 percent by weight of the toner composition.

Colorants that may be incorporated into embodiments include pigments, dyes, mixtures of pigments, mixtures of dyes and mixtures of pigments with dyes, and the like. For example, various known black, cyan, magenta, yellow, red, green, brown, or blue colorants, or mixtures thereof may be incorporated into toner compositions of embodiments. The colorant may be, for example, dyes, pigments, mixtures thereof, mixtures of pigments, mixtures of dyes, and the like. The colorant may have, in embodiments, a mean colorant size of from about 50 to about 150 nanometers. The pigment or pigments can be used as water-based pigment dispersions in embodiments.

Various suitable colorants can be employed in toners of embodiments, including suitable colored pigments, dyes, and mixtures thereof, including carbon black, such as REGAL 330 carbon black, acetylene black, lamp black, aniline black, Chrome Yellow, Zinc Yellow, SICOFAST Yellow, SUNBRITE Yellow, LUNA Yellow, NOVAPERM Yellow, Chrome Orange, BAYPLAST Orange, Cadmium Red, LITHOL Scarlet, HOSTAPERM Red, FANAL PINK, HOSTAPERM Pink, LUPRETON Pink, LITHOL Red, RHODAMINE Lake B, Brilliant Carmine, HELIOGEN Blue, HOSTAPERM Blue, NEOPAN Blue, PV Fast Blue, CINQUASSI Green, HOSTAPERM Green, titanium dioxide, cobalt, nickel, iron powder, SICOPUR 4068FF, and iron oxides such as MAPICO Black (Columbia) NP608 and NP604 (Northern Pigment), BAYFERROX 8610 (Bayer), M08699 (Mobay), TMB-100 (Magnox), mixtures thereof and the like.

The colorant of embodiments may be incorporated in an amount sufficient to impart the desired color to the toner. In general, pigment or dye may be employed in an amount ranging from about 2 percent to about 35 percent by weight of the toner particles on a solids basis, or from about 5 percent to about 25 percent by weight or even from about 5 percent to about 15 percent by weight.

In embodiments, magnetites may be included, either for their magnetic properties, or for the colorant properties, or both. Magnetites that may be used in toner compositions of embodiments include, but are not limited to, a mixture of iron oxides ($FeO \cdot Fe_2O_3$), including those commercially available as Mobay magnetites MO8029™, MO8060™; Columbian magnetites; MAPICO BLACKS™ and surface-treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. In embodiments, a magnetite may be present in a toner composition in an effective amount. In embodiments, the magnetite is present in an amount of from about 10 percent by weight to about 75 percent by weight of the toner composition. In embodiments, the magnetite is present in an amount of from about 30 percent by weight to about 55 percent by weight of the toner composition.

The toner compositions of embodiments may include suitable waxes. In embodiments, wax may be present in a toner composition in an amount of about 0.01 percent by weight to about 9 percent by weight, based on the weight of the toner composition. In embodiments, the wax is present in the toner composition in an amount of about 0.1 percent by weight to about 5 percent by weight, or about 1 percent by weight to about 3.55 percent by weight, based on the weight of the toner composition.

To incorporate wax into a toner composition, it is generally necessary for the wax to be in the form of an aqueous emulsion or dispersion of solid wax particles in water. Emulsions, by the classical definition, are mixtures of two immiscible liquids stabilized by an emulsifier, and therefore, in the case of wax, exist only when the wax is in its molten state as the emulsion is formed. However, the terminology "wax emulsion" is widely used in the industry and herein to describe both true wax emulsions and dispersions of solid wax in solvents, such as water. The wax emulsions of embodiments comprise submicron wax particles of from about 50 to about 500 nanometers, or of from about 100 to about 350 nanometers, suspended in an aqueous water phase containing an ionic surfactant. The ionic surfactant may be present in an amount of from about 0.5 percent by weight to about 10 percent by weight, and of from about 1 percent by weight to about 5 percent by weight of the wax.

The wax emulsions according to embodiments of the present invention comprise a wax selected from a natural vegetable waxes, natural animal waxes, mineral waxes, synthetic waxes and fimctionalized waxes. Examples of natural vegetable waxes include, for example, carnauba wax, candelilla wax, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes include, for example, Fischer-Tropsch wax, acrylate wax, fatty acid amide wax, silicone wax, polytetrafluoroethylene wax, polyethylene wax, and polypropylene wax, and mixtures thereof. Examples of waxes of embodiments include polypropylenes and polyethylenes commercially available from Allied Chemical and Baker Petrolite, wax emulsions available from Michelman Inc. and the Daniels Products Company, EPOLENE N-15 commercially available from Eastman Chemical Products, Inc., VISCOL 550-P, a low weight average molecular weight polypropylene available from Sanyo Kasei K.K., and similar materials. The commercially available polyethylenes usually possess a molecular weight Mw of from about 1,000 to about 1,500, while the commercially available polypropylenes utilized have a molecular weight of about 4,000 to about 5,000. Examples of functionalized waxes include amines, amides, imides, esters, quaternary amines, carboxylic acids or acrylic polymer emulsion, for example, JONCRYL 74, 89, 130, 537, and 538, all available from Johnson Diversey, Inc., chlorinated polypropylenes and polyethylenes commercially available from Allied Chemical and Petrolite Corporation and JohnsonDiversey, Inc. Many of the polyethylene and polypropylene compositions useful in embodiments are illustrated in British Pat. No. 1,442,835, the entire disclosure of which is incorporated herein by reference.

Curing agents that may be mentioned for use in accordance with embodiments include epoxy phenol novolacs and epoxy cresol novolacs; isocyanate curing agents blocked with oximes, such as isopherone diisocyanate blocked with methyl ethyl ketoxime, tetramethylene xylene diisocyanate blocked with acetone oxime, and Desmodur W (dicyclohexylmethane diisocyanate curing agent) blocked with methyl ethyl ketoxime; light-stable epoxy resins such as SANTOLINK LSE 120 supplied by Monsanto; alicyclic poly-epoxides such as EHPE-3150 supplied by Daicel; polyfunctional amines; dicyanodiamide; bisphenol A; bisphenol S; hydrogenated bisphenol; polyphenolics; imidazoles, such as 2-methyl imidazole and 2-phenyl imidazole; betahydroxy-alkylamide; uretdione; and polyfunctional isocyanates, such as 2,4-toluene diisocyanate, 2,6-toluene diisocyanate, alkaline diisocyanates, xylene-diisocyanate, isophorone-diisocyanate, methylene-bis (4-phenyl isocyanate),methylene-bis-(4-cyclohexyl)isocyanate, 3,3'-bitoluene-4-4'-diisocyanate, hexamethylene-diisocyanate, and naphthalene 1,5-diisocyanate; as well as other known or later developed curing agents and initiators, and mixtures thereof.

In embodiments, a charge additive may be used in suitable effective amounts. In embodiments, the charge additive is used in amounts from about 0.1 percent by weight to about 15 percent by weight of the toner composition. In embodiments, the charge additive is used in amounts from about 1 percent by weight to about 15 percent by weight of the toner composition. In embodiments, the charge additive is used in amounts from about 1 percent by weight to about 3 percent by weight of the toner composition. Suitable charge additives in embodiments include, but are not limited to, alkyl pyridinium halides, bisulfates, the charge control additives of U.S. Pat. Nos. 3,944,493; 4,007,293; 4,079,014; 4,394,430 and 4,560,635, the disclosures of which are incorporated herein by reference in their entirety, negative charge enhancing additives, such as, for example, aluminum complexes, and other charge additives known in the art or later discovered or developed.

In addition, the toners may also optionally contain a coagulant and/or flow agents, such as colloidal silica. Suitable optional coagulants include any coagulant known or used in the art, including the well known coagulants polyaluminum chloride (PAC) and/or polyaluminum sulfosilicate (PASS). A preferred coagulant is polyaluminum chloride. The coagulant is present in the toner particles, exclusive of external additives and on a dry weight basis, in amounts of from 0 to about 3% by weight of the toner particles, preferably from about greater than 0 to about 2% by weight of the toner particles. The flow agent, if present, may be any colloidal silica such as SNOWTEX OL colloidal silica, SNOWTEX OS colloidal silica, and/or mixtures thereof. The colloidal silica is present in the toner particles, exclusive of external additives and on a dry weight basis, in amounts of from 0 to about 15% by weight of the toner particles, preferably from about greater than 0 to about 10% by weight of the toner particles.

The toner may also include additional known positive or negative charge additives in effective suitable amounts of, for example, from about 0.1 to about 5 weight percent of the toner, such as quaternary ammonium compounds inclusive of alkyl pyridinium halides, bisulfates, organic sulfate and sulfonate compositions such as disclosed in U.S. Pat. No. 4,338,390, cetyl pyridinium tetrafluoroborates, distearyl dimethyl ammonium methyl sulfate, aluminum salts or complexes, and the like.

Also, in preparing the toner by the emulsion aggregation procedure, one or more surfactants may be used in the process. Suitable surfactants include anionic, cationic and nonionic surfactants. Surfactants for the preparation of latexes and other dispersions can be ionic or nonionic surfactants in an amount of about 0.01 percent by weight to about 15 percent by weight, or about 0.01 percent by weight to about 5 percent by weight, of the reaction mixture.

Anionic surfactants include sodium dodecylsulfate (SDS), sodium dodecyl benzene sulfonate, sodium dodecylnaphthalene sulfate, dialkyl benzenealkyl, sulfates and sulfonates, abitic acid, and the NEOGEN brand of anionic surfactants. An example of a preferred anionic surfactant is NEOGEN RK available from Daiichi Kogyo Seiyaku Co. Ltd., or TAYCA POWER BN2060 from Tayca Corporation (Japan), which consists primarily of branched sodium dodecyl benzene sulphonate.

Examples of cationic surfactants include dialkyl benzene alkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quatemized polyoxyethylalkylamines, dodecyl benzyl triethyl ammonium chloride, MIRAPOL and ALKAQUAT available from Alkaril Chemical Company, SANISOL (benzalkonium chloride), available from Kao Chemicals, and the like. An example of a preferred cationic surfactant is SANISOL B-50 available from Kao Corp., which consists primarily of benzyl dimethyl alkonium chloride.

Examples of nonionic surfactants include polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc Inc. as IGEPAL CA-210, IGEPAL CA-520, IGEPAL CA-720, IGEPAL CO-890, IGEPAL CO-720, IGEPAL CO-290, IGEPAL CA-210, ANTAROX 890 and ANTAROX 897. An example of a preferred nonionic surfactant is ANTAROX 897 available from Rhone-Poulenc Inc., which consists primarily of alkyl phenol ethoxylate.

The toner compositions of embodiments may also include fillers, such as, for example, quartz; silicates; aluminosilicates; corundum; ceramic fillers; glass; carbonates, such as chalk, kaolin; inorganic fibers and the like; calcium sulfate; barium sulfate; magnesium sulfate; and any other known or later developed filler materials. The fillers can be included in amounts suitable to adjust the rheological characteristics of the toner composition.

Any suitable emulsion aggregation procedure may be used in forming the emulsion aggregation toner particles without restriction. In embodiments, these procedures typically include the basic process steps of at least aggregating an emulsion containing binder, optionally one or more colorants, optionally one or more surfactants, optionally a wax emulsion, optionally a coagulant and one or more additional optional additives to form aggregates, subsequently coalescing or fusing the aggregates, and then recovering, optionally washing and optionally drying the obtained emulsion aggregation toner particles. However, in embodiments, at least one leveling agent is included in the emulsion at aggregation.

An example emulsion/aggregation/coalescing process of embodiments includes forming a mixture of latex binder, leveling agent, optional colorant, optional additive dispersions or emulsions, optional coagulant and deionized water in a vessel. The mixture is then stirred using a homogenizer until homogenized and then transferred to a reactor where the homogenized mixture is heated to a temperature of, for example, about 50° C. and held at such temperature for a period of time to permit aggregation of toner particles to the desired size. Once the desired size of aggregated toner particles is achieved, the pH of the mixture is adjusted in order to inhibit further toner aggregation. The toner particles are further heated to a temperature of, for example, about 90° C. and the pH lowered in order to enable the particles to coalesce and spherodize. The heater is then turned off and the reactor mixture allowed to cool to room temperature, at which point the aggregated and coalesced toner particles are recovered and optionally washed and dried.

In embodiments, dilute solutions of flocculates or aggregating agents may be used to optimize particle aggregation time with as little fouling and coarse particle formation as possible.

In particular embodiments, flocculates are included in an amount from about 0.01 percent by weight to about 10 percent by weight of the toner composition. Flocculates used in various embodiments include, but are not limited to, polyaluminum chloride (PAC), dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quatemized polyoxyethylalkylamines, dodecylbenzyl triethyl ammonium chloride, MIRAPOL™ and ALKAQUAT™ (available from Alkaril Chemical Company), SANIZOL™ (benzalkonium chloride) (available from Kao Chemicals), and the like, and mixtures thereof.

Any aggregating agent capable of causing complexation might suitably be used. Both alkali earth metal or transition metal salts can be utilized as aggregating agents. Examples of the alkali (II) salts that can be selected to aggregate the sodio sulfonated polyester colloid with a colorant to enable the formation of the toner composite are preferably selected from beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, and barium iodide. Examples of transition metal salts or anions include acetates, acetoacetates, sulfates of vanadium, niobium, tantalum, chromium, molybdenum, tungsten, manganese, iron, ruthenium, cobalt, nickel, copper, zinc, cadmium, silver or aluminum salts such as aluminum acetate, polyaluminum chloride, aluminum halides, mixtures thereof and the like, and wherein the concentration thereof is optionally in the range of from about 0.1 percent by weight to about 5 percent by weight of water. In embodiments, the aggregating agent is selected from zinc acetate and polyaluminum chlorides.

Following addition of the optional flocculate or aggregating agent into the vessel, the aggregation step conditions may be continued for a period of time until toner composition particles of the desired size and size distribution are obtained. The size may be monitored by taking samples from the vessel and evaluating the size of the toner composition particles, for example with a particle sizing apparatus. In various exemplary embodiments of the invention, the aggregate particles have volume average diameter of less than 30 microns, from about 1 to about 25 microns, or from about 3 to about 10 microns, and narrow GSD of, for example, from about 1.10 to about 1.25, or from about 1.10 to about 1.20, as measured by a particle sizing apparatus, such as a particle sizing apparatus which makes use of the Coulter principle, such as a COULTER COUNTER, can be obtained.

Once the aggregate particles reach the desired size, the resulting suspension is allowed to coalesce. This may be achieved by heating to a temperature at or above the glass transition temperature of the resin.

These particles can be removed from the suspension, such as by filtration, and subjected to washing/rinsing with, for example, water to remove residual aggregating agent, and drying, to obtain toner composition particles comprised of resin, wax and optional additives, such as colorants and curing agents. In addition, the toner composition particles may be subjected to screening and/or filtration steps to remove undesired coarse particles from the toner composition.

In embodiments, washing may be carried out at a pH of from about 7 to about 12, and, in embodiments, at a pH of from about 9 to about 11, at a temperature of from about 45 to about 70° C., or from about 50 to about 70° C. The washing may comprise filtering and reslurrying a filter cake comprised of toner particles in deionized water. The filtering and reslurrying may be washed one or more times by deionized water, or washed by a single deionized water wash at a pH of about 4 wherein the pH of the slurry is adjusted with an acid, and followed optionally by one or more deionized water washes.

The toner composition of embodiments comprises toner particles having a volume average diameter of less than about 30 microns, such as from about 1 to about 15 microns, or from about 3 to about 10 microns, and a particle size distribution of less than about 1.25, such as from about 1.0 to about 1.25, or from about 1.15 to about 1.20; each measured, for example, with a particle sizing apparatus, such as a particle sizing apparatus which makes use of the Coulter principle, such as a COULTER COUNTER, wherein the toner has stable triboelectric charging performance. A narrow particle size distribution enables a clean transfer of toner particles, thereby providing enhanced resolution of the resulting developed fused images. The toner particles of embodiments may comprise a small particle size and narrow size distribution.

In embodiments, the toner composition may incorporate, for example by dry-blending, one or more external surface additive, such as fluidity-assisting additives, for example, those disclosed in WO94/11446, curing agents; flow-promoting and flow-control agents; charge additives, such as those described above; and fillers such as aluminum oxide and silica, either singly or in combination. In addition, other additives may be included.

The toner compositions of the present invention may also optionally be blended with flow-promoting and flow-control agents, such as external additive particles, which are usually present on the surface of the toner compositions. Examples of these additives include, but are not limited to, metal oxides such as titanium oxide, tin oxide, mixtures thereof, and the like; colloidal silicas such as AEROSILE®, metal salts and metal salts of fatty acids including zinc stearate, aluminum oxides, cerium oxides; and mixtures thereof. In embodiments, these flow-aid agents may be present in amounts of from about 0.1 percent by weight to about 5 percent by weight, and in amounts of from about 0.1 percent by weight to about 1 percent by weight. Several of the aforementioned additives are illustrated in U.S. Pat. Nos. 3,590,000 and 3,800,588, the disclosures of which are incorporated herein by reference in their entirety.

The total content of dry-blended additives incorporated with the toner composition of embodiments may be in the range of from about 0.01 percent by weight to about 10 percent by weight, and in some embodiments, may be in the range of from about 0.1 percent by weight to about 1.0 percent by weight, based on the total weight of the composition without the additives. However, higher or lower amounts of additives may also be used.

The toner particles of embodiments may be blended with external additives following formation. Any suitable surface additives may be used in embodiments. In particular embodiments, one or more of $SiO_2$, metal oxides such as, for example, $TiO_2$ and aluminum oxide, and a lubricating agent such as, for example, a metal salt of a fatty acid, for example, zinc stearate or calcium stearate, or long chain alcohols such as UNILIN700, may be used as external surface additives. In general, silica is applied to the toner surface for toner flow, tribo enhancement, admix control, improved development and transfer stability and higher toner blocking temperature. $TiO_2$ is applied for improved relative humidity (RH) stability, tribo control and improved development and transfer stability. Zinc stearate may also used as an external additive for the toners of embodiments, the zinc stearate providing lubricating properties. Zinc stearate provides developer conductivity and tribo enhancement, both due to its lubricating nature. In addition, zinc stearate enables higher toner charge and charge stability by increasing the number of contacts between toner and carrier particles. Calcium stearate and magnesium stearate provide similar functions. The external surface additives of embodiments can be used with or without a coating.

In certain embodiments, the toners contain from, for example, about 0.1 to about 5 percent by weight of titania, about 0.1 to about 8 percent by weight of silica and about 0.1 to about 4 percent by weight of zinc stearate.

The process of the present invention can be used to produce toner particles within any sized reactor, and is thus commercially significant. Scaling up of the process from bench reactors to larger reactors can be readily achieved by practitioners in the art.

Developer compositions can be prepared by mixing the toners obtained with the process of the present invention with known or later developed carrier particles. Illustrative examples of carrier particles that can be selected for mixing with the toner composition prepared in accordance with the embodiments include those particles that are capable of triboelectrically obtaining a charge of opposite polarity to that of the toner particles. Accordingly, in embodiments, the carrier particles may be selected so as to be of a negative polarity in order that the toner particles that are positively charged will adhere to and surround the carrier particles. Illustrative examples of such carrier particles include iron, iron alloys steel, nickel, iron ferrites, including ferrites that incorporate strontium, magnesium, manganese, copper, zinc, and the like, magnetites, and the like. Additionally, there can be selected as carrier particles nickel berry carriers as disclosed in U.S. Pat. No. 3,847,604, the entire disclosure of which is totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are totally incorporated herein by reference.

The selected carrier particles of embodiments can be used with or without a coating, the coating generally being comprised of acrylic and methacrylic polymers, such as methyl methacrylate, acrylic and methacrylic copolymers with fluoropolymers or with monoalkyl or dialklyamines, fluoropolymers, polyolefins, polystrenes such as polyvinylidene fluoride resins, terpolymers of styrene, methyl methacrylate, and a silane, such as triethoxy silane, tetrafluoroethylenes, other known coatings and the like.

The carrier particles can be mixed with the toner particles in various suitable combinations. The toner concentration is usually about 2 percent to about 10 percent by weight of toner and about 90 percent to about 98 percent by weight of carrier. However, one skilled in the art will recognize that different toner and carrier percentages may be used to achieve a developer composition with desired characteristics.

The toner and developer compositions of embodiments may also include dry-blended fillers, such as, for example, quartz; silicates; aluminosilicates; corundum; ceramic fillers; glass; carbonates, such as chalk, kaolin; inorganic fibers and the like; calcium sulfate; barium sulfate; magnesium sulfate; and any other known or later developed filler materials, and are included in amounts suitable to adjust the rheological characteristics of the toner and developer compositions of embodiments.

Toner compositions of embodiments can be used in known electrostatographic imaging methods. The resulting toner and developer compostions can be selected for known electrophotographic imaging, digital, printing processes, including color processes, and lithography. Thus for example, the toners or developers of embodiments can be charged, e.g., triboelectrically, and applied to an oppositely charged latent image on an imaging member such as a photoreceptor or ionographic receiver. The resultant toner image can then be transferred, either directly or via an intermediate transport member, to a support such as paper or a transparency sheet. The toner image can then be fused to the support by application of heat and/or pressure, for example with a heated fuser roll.

Specific examples will now be described in detail. These examples are intended to be illustrative, and the invention is not limited to the materials, conditions, or process parameters set forth in these embodiments. All parts and percentages are by weight unless otherwise indicated.

EXAMPLES

Comparative Example—Preparation of Magenta Chemical Toner—Baseline 184.1 grams of a styrene-butyl acrylate-β-carboxyethyl acrylate (β-CEA) copolymer latex (latex A), 60.0 grams of magenta pigment PR122and 10.6 grams of magenta pigment PR185 was added to 437.2 grams of distilled water. The mixture was controlled at a jacket temperature of 20° C. in a 2 L glass reactor. 44.64 grams of a polyethylene wax dispersion at 31% solids was added to the reactor and then homogenized at a speed of 4,000 rpm. One minute later, 44.71 grams of a silica/polyaluminum chloride (SiPAC) coagulant mixture was added over a period of 4 minutes. The SiPAC consisted of 7.5 grams of colloidal silica particles, 8.1 grams of 0.02 M nitric acid solution and 0.09 grams polyaluminum chloride (PAC). Immediately following, 5.0 grams of a concentrated polyaluminum chloride solution was added over 2 minutes. The concentrated PAC solution consisted of 0.15 grams PAC and 13.5 grams of 0.02 M nitric acid solution. The resulting mixture was allowed to blend for an additional twenty minutes at the set speed. After the 20 minutes, the temperature of the reaction vessel was raised to 55.5° C., the homogenizer unit was removed and a pitched blade impeller was used to stir the mixture at 240 rpm for 135 minutes.

103.1 grams of latex A was then added to the reaction vessel over 8 minutes. After 20 minutes the pH was adjusted from 2.621 to 6.250 using a 4% sodium hydroxide solution followed by stirring for 15 minutes. The mixtures was then allowed to ramp to 95.5° C. and held for a total of 4 hrs and 30 minutes. The mixture was then cooled to 20° C., sieved through a 88 micron screen and washed 4 times. The first wash was completed at a pH of 10 and the third wash was completed at a pH of 4. The particles were then freeze dried.

The resulting toner particles have a geometric size distribution (GSD) of 5.4 microns.

The particles were blended with external additives, such as silica and titanium dioxide. Eight identical toner compositions were prepared from the toner particles of Comparative Example 1. These toner compositions were subjected to reprographic imaging in a bench fuser, using fuser temperatures in the range of 130 to 180° C. The results of these tests are shown in Table 1 and in FIGS. 1 and 2.

For each toner composition, the gloss was determined at 10° C. increments of fuser temperature. The gloss of each toner composition was measured using a Garner Micro-Gloss Meter at 75° C., in Garner Gloss Units (ggu).

In addition, the stripping force required to separate the fused toner image from the fuser component was measured for fuser temperatures in the range of 140 to 180° C. The stripping force, which is measured by a strain gauge, is determined as each section of fused toner passes a nip. The strain gauge records the force required to separate the fused toner from the fuser component, and the peak force is recorded for each fusing temperature. Stripping force is calculated in grams of force ($g_f$).

TABLE 1

| Temperature (° C.) | Gloss (ggu) | Stripping Force (gf) |
|---|---|---|
| 130 | 14 | — |
| 140 | 22 | 9.95 |
| 150 | 31 | 6.13 |
| 160 | 46 | 7.31 |
| 170 | 54 | 8.19 |
| 180 | 63 | 7.31 |

Example—Preparation of Polyether-modified Polysiloxane Magenta Chemical Toner 184.1 grams of a styrene-butyl acrylate-β-carboxyethyl acrylate (β-CEA) copolymer latex (latex A), 60.0 grams of magenta pigment PR122 and 10.6 grams of magenta pigment PR185 was added to 437.2 grams of distilled water. The mixture was controlled at a jacket temperature of 20° C. in a 2 L glass reactor. 44.64 grams of a polyethylene wax dispersion at 31% solids was added to the reactor and then homogenized at a speed of 4,000 rpm. One minute later, 44.71 grams of a silica/polyaluminum chloride (SiPAC) coagulant mixture was added over a period of 4 minutes. The SiPAC consisted of 7.5 grams of colloidal silica particles, 8.1 grams of 0.02 M nitric acid solution and 0.09 grams polyaluminum chloride (PAC). Immediately following, 5.0 grams of a concentrated polyaluminum chloride solution was added over 2 minutes. The concentrated PAC solution consisted of 0.15 grams PAC and 13.5 grams of 0.02 M nitric acid solution. The resulting mixture was allowed to blend for an additional twenty minutes at the set speed. After the 20 minutes, the temperature of the reaction vessel was raised to 55.5° C., the homogenizer unit was removed and a pitched blade impeller was used to stir the mixture at 240 rpm for 122 minutes.

103.1 grams of latex A was mixed with 37.5 grams of a 25% aqueous solution of TEGOGLIDE 455 (100% polyether-modified polysiloxane). The pH was at 1.860 and adjusted to 1.309 using nitric acid. The mixture was then added to the reaction vessel over 11 minutes. After 30 minutes the pH was adjusted from 2.060 to 6.034 using a 4% sodium hydroxide solution followed by stirring for 15 minutes. The mixtures was then allowed to ramp to 95.5° C. and held for a total of 4 hours and 30 minutes. The mixture was then cooled to 20° C., sieved through an 88 micron screen and washed 4 times. The first wash was completed at a pH of 10 and the third wash was completed at a pH of 4. The particles were then freeze dried.

The resulting toner particles have a GSD of 5.7 microns.

The toner particles were blended with external additives, such as silica and titanium dioxide, and eight identical toner compositions were prepared from the toner particles of Example 1. These toner compositions were subjected to reprographic imaging in a bench fuser, using fuser temperatures in the range of 130 to 180° C. The results of these tests are shown in Table 2 and in FIGS. 1 and 2.

For each toner composition, the gloss was determined at 10° C. increments of fuser temperature.

In addition, the stripping force required to separate the fused toner image from the fuser component was measured for fuser temperatures in the range of 140 to 180° C.

TABLE 2

| Temperature (° C.) | Gloss (ggu) | Stripping Force (gf) |
|---|---|---|
| 130 | 25 | — |
| 140 | 33 | 13.19 |
| 150 | 43 | 13.48 |
| 160 | 50 | 14.96 |
| 170 | 56 | 16.72 |
| 180 | 60 | 26.42 |

As can be seen from FIG. 1, the toner composition according to Example 1 exhibits increased gloss relative to the toner composition according to Comparative Example, when processed at identical fuser temperatures, below a temperature of approximately 175° C. In addition, the toner composition according to Example 1 requires a lower fusing temperature to achieve a gloss equivalent to that of the toner composition according to the Comparative Example exhibit, below a temperature of approximately 175° C. Thus, an imaging apparatus used to process the toner of embodiments such as described in Example 1 can be set up to produce images having similar or even superior gloss at lower temperatures, and lower energy cost, when compared to conventional toner compositions, such as described in Comparative Example 1.

Figure 2:
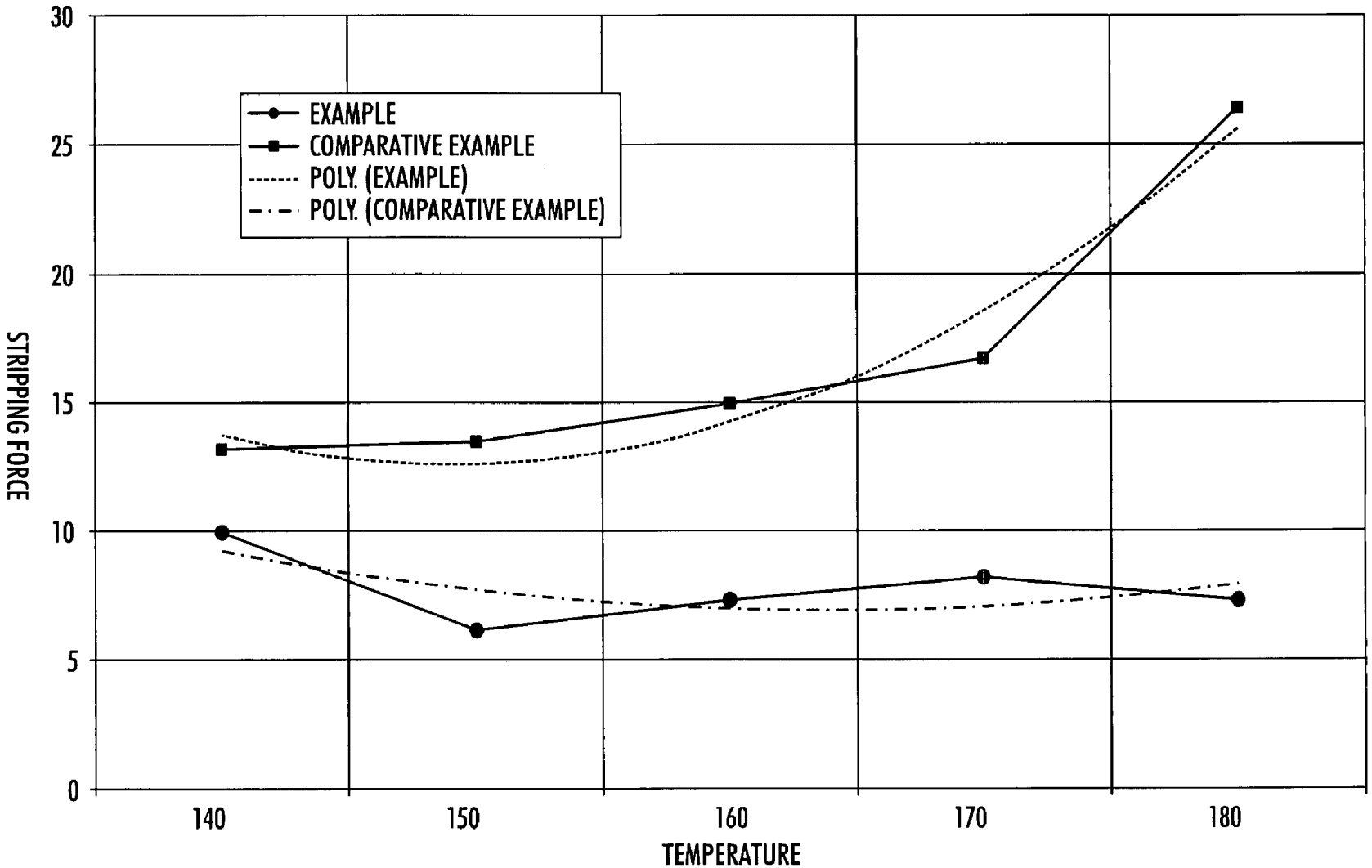
FIG. 2 is a graphical representation of the relationship between stripping force and fusing temperature for a conventional chemical toner and a chemical toner according to an embodiment.

As can be seen from FIG. 2, the stripping force required to remove the toner composition according to Example 1 from a fuser component after fusing is lower at all fusing temperatures to that necessary to remove the toner composition according to Comparative Example. Thus, an imaging apparatus used to process the toner of embodiments such as described in Example 1 can be set up to produce images having similar or even superior gloss at lower temperatures, lower energy cost, as well as improved releasability of the fused toner image from the fuser, when compared to conventional toner compositions, such as described in Comparative Example 1.

What is claimed is:

1. A toner composition comprising toner particles formed by an emulsion/aggregation process, wherein the emulsion/aggregation process comprises:

providing one or more aqueous dispersions, the aqueous dispersions comprising one or more leveling agent and particles including particles of one or more resins;

homogenizing the aqueous dispersions;

aggregating particles to form aggregated particles;

coalescing the aggregated particles to form fused particles; and optionally removing the fused particles from the aqueous dispersion;

wherein the fused particles have an average particle diameter of from about 1 to about 15 microns, with a particle geometric size distribution of less than about 1.25.

2. The toner composition according to claim 1, wherein the resins are one or more resins chosen from the group consisting of thermoplastic resins, thermoset resins, curable resins and mixtures thereof.

3. The toner composition according to claim 1, wherein the resins are chosen from the group consisting of polyester resins and copolymers of styrene.

4. The toner composition according to claim 1, wherein the leveling agents are chosen from the group consisting of silicones, polysiloxanes, functionalized polysiloxanes, fluorocarbon surfactants, and mixtures thereof.

5. The toner composition according to claim 1, wherein the leveling agents are chosen from the group consisting of polyether-functionalized polysiloxanes and mixtures thereof.

6. The toner composition according to claim 1, wherein the toner particles further comprise one or more additives.

7. The toner composition according to claim 6, wherein the additives are one or more additive chosen from the group consisting of colorants; magnetites; flocculates; curing agents; waxes; charge additives; flow-promoting agents; flow-control agents; plasticizers; stabilizers; anti-gassing and degassing agents; surface additives; antioxidants; UV absorbers; light stabilizers; fillers and mixtures thereof.

8. A process for preparing toner particles, the process comprising:

providing one or more aqueous dispersions, the aqueous dispersions comprising one or more leveling agent and particles including particles of one or more resins;

homogenizing the aqueous dispersions;

aggregating particles to form aggregated particles;

coalescing the aggregated particles to form fused particles; and optionally removing the fused particles from the aqueous dispersion;

wherein the fused particles have an average particle diameter of from about 1 to about 15 microns, with a particle geometric size distribution of less than about 1.25.

9. The process according to claim 8, wherein the resins are one or more resins chosen from the group consisting of thermoplastic resins, thermoset resins, curable resins and mixtures thereof.

10. The process according to claim 8, wherein the resins are chosen from the group consisting of polyester resins and copolymers of styrene.

11. The process according to claim 8, wherein the leveling agents are chosen from the group consisting of silicones, polysiloxanes, functionalized polysiloxanes, fluorocarbon surfactants, and mixtures thereof.

12. The process according to claim 8, wherein the leveling agents are chosen from the group consisting of polyether-functionalized polysiloxanes and mixtures thereof.

13. The process according to claim 8, wherein the toner particles further comprise one or more additives.

14. The process according to claim 13, wherein the additives are one or more additive chosen from the group consisting of colorants; magnetites; flocculates; curing agents; leveling agents; charge additives; flow-promoting agents; flow-control agents; plasticizers; stabilizers; anti-gassing and degassing agents; surface additives; antioxidants; UV absorbers; light stabilizers; fillers and mixtures thereof.

15. A developer composition comprising a toner composition, wherein the toner composition comprises toner particles formed by an emulsion/aggregation process, wherein the emulsion/aggregation process comprises:

providing one or more aqueous dispersions, the aqueous dispersions comprising one or more leveling agent and particles including particles of one or more resins;

homogenizing the aqueous dispersions;

aggregating particles to form aggregated particles;

coalescing the aggregated particles to form fused particles; and optionally removing the fused particles from the aqueous dispersion;

wherein the fused particles have an average particle diameter of from about 1 to about 15 microns, with a particle geometric size distribution of less than about 1.25.

16. The developer composition according to claim 15, wherein the resins are one or more resins chosen from the group consisting of thermoplastic resins, thermoset resins, curable resins and mixtures thereof.

17. The developer composition according to claim 15, wherein the resins are chosen from the group consisting of polyester resins and copolymers of styrene.

18. The developer composition according to claim 15, wherein the leveling agents are chosen from the group consisting of silicones, polysiloxanes, functionalized polysiloxanes, and mixtures thereof.

19. The developer composition according to claim 15, wherein the leveling agents are chosen from the group consisting of polyether-functionalized polysiloxanes and mixtures thereof.

20. The developer composition according to claim 15, wherein the toner particles further comprise one or more additives chosen from the group consisting of colorants; magnetites; flocculates; curing agents; waxes; charge additives; flow-promoting agents; flow-control agents; plasticizers; stabilizers; anti-gassing and degassing agents; surface additives; antioxidants; UV absorbers; light stabilizers; fillers and mixtures thereof.

* * * * *

UNITED STATES PATENT AND TRADEMARK OFFICE

CERTIFICATE OF CORRECTION

PATENT NO. : 7,279,261 B2
APPLICATION NO. : 11/034067
DATED : October 9, 2007
INVENTOR(S) : Karen Lamora, Eunhee Lee and Grazyna Kmiecik-Lawrynowicz It is certified that error appears in the above-identified patent and that said Letters Patent is hereby corrected as shown below:

Title Page, item [75], "Grazyna Kmieck-Lawrynowicz" should appear as

-- Grazyna Kmiecik-Lawrynowicz --.

Signed and Sealed this

Fifteenth Day of April, 2008

JON W. DUDAS
*Director of the United States Patent and Trademark Office*